US006734757B2

(12) United States Patent
Delzer

(10) Patent No.: US 6,734,757 B2
(45) **Date of Patent: *May 11, 2004**

(54) ADJUSTABLE DELAY LINE PHASE SHIFTER USING A SELECTABLE CONNECTED CONDUCTIVE

(75) Inventor: Donald J. Delzer, Beaverton, OR (US)

(73) Assignee: Tektronix, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/559,985

(22) Filed: Apr. 26, 2000

(65) Prior Publication Data

US 2003/0085775 A1 May 8, 2003

(51) Int. Cl.[7] ..... H01P 1/18
(52) U.S. Cl. ..... 333/161; 333/156

(58) Field of Search ..... 333/156, 161

(56) References Cited

U.S. PATENT DOCUMENTS

| | | | | |
|---|---|---|---|---|
| 4,641,114 A | | 2/1987 | Person | |
| 4,942,373 A | | 7/1990 | Ozawa et al. | |
| 5,030,932 A | * | 7/1991 | Kameya | 333/161 |
| 5,170,140 A | * | 12/1992 | Lowe et al. | 333/161 X |
| 5,694,134 A | * | 12/1997 | Barnes | 333/161 X |
| 5,815,050 A | | 9/1998 | Brooks et al. | |

* cited by examiner

*Primary Examiner*—Benny Lee
(74) *Attorney, Agent, or Firm*—William K. Bucher; Francis I. Gray

(57) ABSTRACT

An adjustable delay line phase shifter is configured as a microstrip transmission line having a M×N matrix of conductive elements mounted on a insulating substrate. The squares are connected together using conductive members, such as gold ribbon or wire bonds, in a pattern that produces a desired amount of phase shift.

16 Claims, 6 Drawing Sheets

ADJUSTABLE DELAY LINE PHASE SHIFTER USING A SELECTABLE CONNECTED CONDUCTIVE

BACKGROUND OF THE INVENTION

The present invention relates generally to delay lines and more specifically to a minimum area adjustable delay line structure useful in providing phase control in high frequency circuit applications.

The prior art teaches miniature delay line circuits with multiple delay outputs as represented in U.S. Pat. No. 4,641,114 and U.S. Pat. No. 4,942,373. Both patents use a stacked packaging configuration employing substrates with delay lines formed thereon. The '114 patent describes delay line circuit assemblies with each assembly consisting of a thick film delay line formed on a dielectric substrate and having a plurality of conductive pads mounted along the edge thereof The delay line is a spiral coil conductor having its opposite ends connected to separate contact pads. Each delay circuit has an initial layer of a solid sheet conductive material, a first layer of dielectric material superimposed over the solid conductor sheet, the spiral coil conductor formed on the dielectric material, and a second sheet of dielectric material covering the spiral conductor. The solid sheet conductive layers are connected to a common conductive pad that may be connected to a common ground. The delay circuit assemblies are stacked one on top of the other with the spiral conductors within each of the delay line circuit assemblies being connected to one another in series. Leads extend from the stack of delay circuit assemblies with each lead being in electrical contact with respective conductive pads. The stacked assemblies and a portion of the leads are coated in an encapsulating dielectric material. Different delay times may be achieved by tapping different leads of the delay line assembly.

The '373 patent describes multi-layered, thick/thin film delay lines which are tailored to provide line impedances yielding unit delays of 1 to 10 nanoseconds. One of the described embodiments comprises a modularly constructed assembly providing for high-density packaging of a number of transmission lines in a single component to achieve multiple outputs or long delay values. The assembly is formed on a fiber/resin substrate on which is formed a serpentine delay line having right and left hand sides. Formed over the lowermost delay line are successively a screen printed polyamide dielectric layer, an evaporated copper ground plane layer and a screen printed polyamide dielectric layer. Lastly, a second transmission line layer similar to the lowermost transmission line is formed on the upper dielectric layer. Contact pads are provided on the ends of the respective transmission lines. Additional contact pads are electrically connected to the ground plane. Contact pins are soldered/bonded to the appropriate contact pads on the lowermost delay line layer. Jumper wires or vias appropriately connect others of the contact pads to the lowermost delay line layer.

One drawback to the above described miniature delay line circuits is the complexity of the manufacturing process. The various layers require individual processing and assembly to produce the delay line circuits. What is needed is an adjustable delay line phase shifter that is simple to produce and occupies a minimum area on a substrate or circuit board.

SUMMARY OF THE INVENTION

Accordingly, the present invention is a minimum area adjustable delay line phase shifter incorporating a microstrip transmission line made up of conductive shapes, such as squares or rectangles with or without beveled corners and the like. The adjustable delay line phase shifter includes a dielectric substrate having an upper surface and a lower surface. A conductive ground layer is deposited on the lower surface of the dielectric substrate. A matrix of conductive elements is deposited on the upper surface of the dielectric substrate in M rows and N columns where M and N are equal to or greater than 2 and having N−1 to (M×N)−1 conductive members electrically connecting from N to (M×N) conductive elements together. A first conductive element acts as an input port and a second conductive element acts as an output port. The preferred embodiment of the invention uses substantially square conductive elements. Alternately, the conductive elements may be substantially rectangular, rectangular with beveled corners, or any geometric or non-geometric shape that does not compromise the overall characteristic impedance of the delay line. Preferably the conductive members are gold ribbons. Alternately, the conductive members may be a plurality of bond wires, such as two or three bond wires connecting two conductive elements. The objects, advantages and novel features of the present invention are apparent from the following detailed description when read in conjunction with the appended claims and attached drawings.

DETAILED DESCRIPTION OF THE PREFERRED EMBODIMENT

The adjustable delay line phase shifter of the present invention is described using a microstrip transmission line having a characteristic impedance of 50 ohms that is formed on a hybrid substrate. It is well known to those of skill in the art of transmission line design that the characteristic impedance of a microstrip transmission line may be varied as a function of the thickness of the substrate on which the transmission line is formed and on the width of the transmission line itself. The adjustable delay line phase shifter may be implemented using a microstrip transmission line having a characteristic impedance other than 50 ohms without departing from the claimed invention. Further, the adjustable delay line phase shifter of the present invention is implemented using a thick film screening process that is well known in the art. Thin film deposition processes, also well known in the art, may be used to implement the present invention as well as copper etching on a circuit board.

Figure 1B:
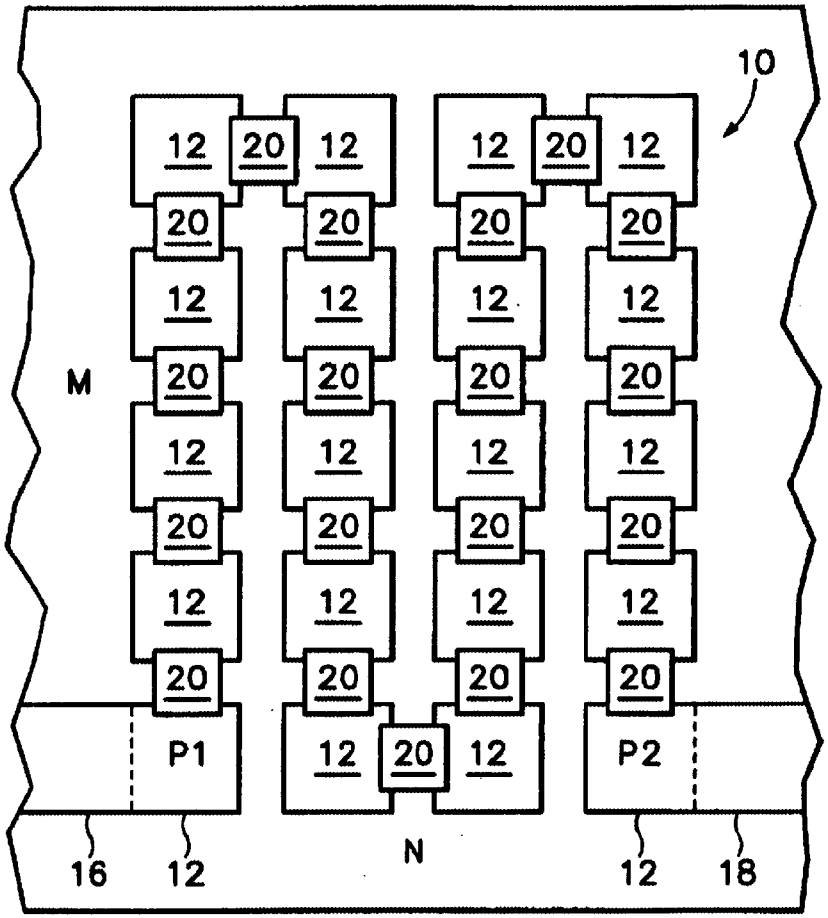
FIGS. 1A and 1B are plan views of two configurations of the adjustable delay line phase shifter according to the present invention.
Figure 1A:
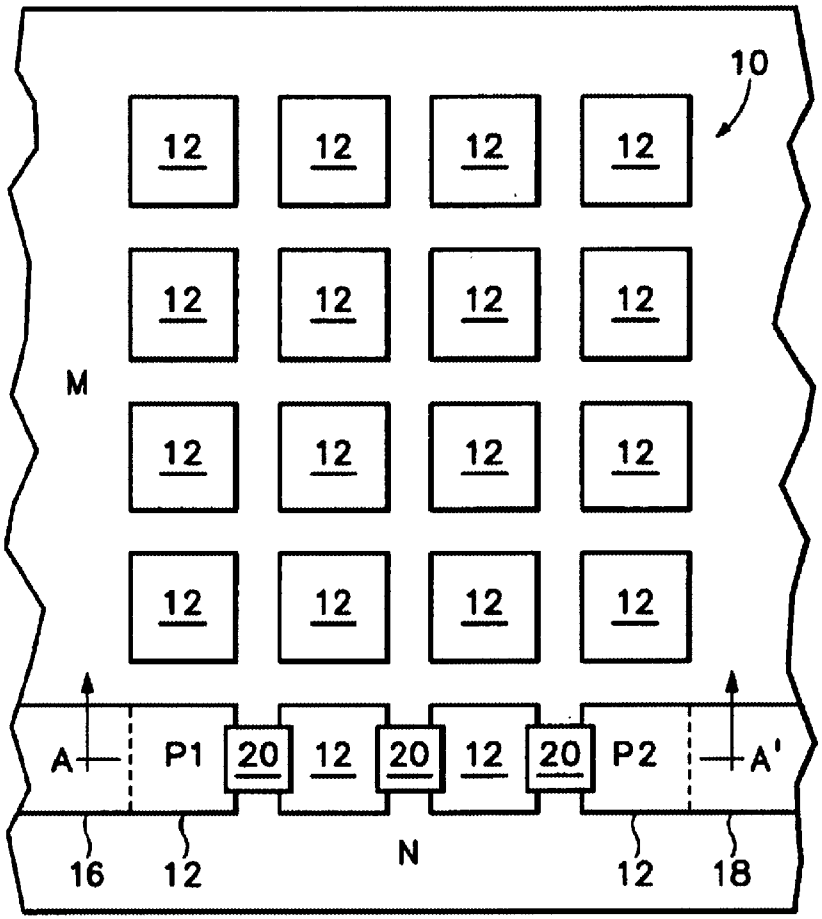

FIG. 1A and FIG. 1B illustrate plan views of two configurations of the adjustable delay line phase shifter 10 according to the present invention. Like elements in these figures and subsequent figures are labeled the same but may not be described in detail for all figures. FIG. 1A is configured with a minimum amount of delay and FIG. 1B is configured with a maximum amount of delay. The adjustable delay line 10 has a matrix of conductive elements 12 formed on the upper surface of a substrate. The matrix has M rows and N columns where M and N are greater than or equal to 2. In the preferred embodiment, the matrix has five rows and four columns. The conductive elements are 25 mil squares with 5 mil spacing between the squares. Two of the squares, labeled P1 and P2, are contiguously formed with incoming and outgoing transmission lines 16 and 18 and act as input and output ports for the adjustable delay line 10. Conductive members 20, such as 20 mil wide gold ribbon or multiple bond wires electrically connect the conductive elements 12 together. There is one less conductive member 20 connecting the conductive elements 12 together for any configuration of the adjustable delay line 10. The adjustable delay line 10 of FIG. 1B illustrates the preferred serpentine connecting pattern of the conductive elements 12. The conductive elements 12 of each row in the matrix are electrically connected together with conductive members 20 and the columns are electrically connected together by alternately connecting the ends of the columns together using conductive members 20. The serpentine connection pattern, as represented in FIG. 1B, is preferred because it minimizes the number of corners in the delay line 10 so as to maintain the desired characteristic impedance of the delay line 10. In any of the connecting patterns for the adjustable delay line 10, it is desirable to minimize the number of corners in connecting the conductive elements together. In the embodiments of FIGS. 1A and 1B, each conductive element 12 has a delay in the range of 4.4 picoseconds and each conductive member has a delay in the range of 1.1 picosecond resulting in a maximum delay for the delay line 10 in the range of 100 picoseconds.

Figure 2:
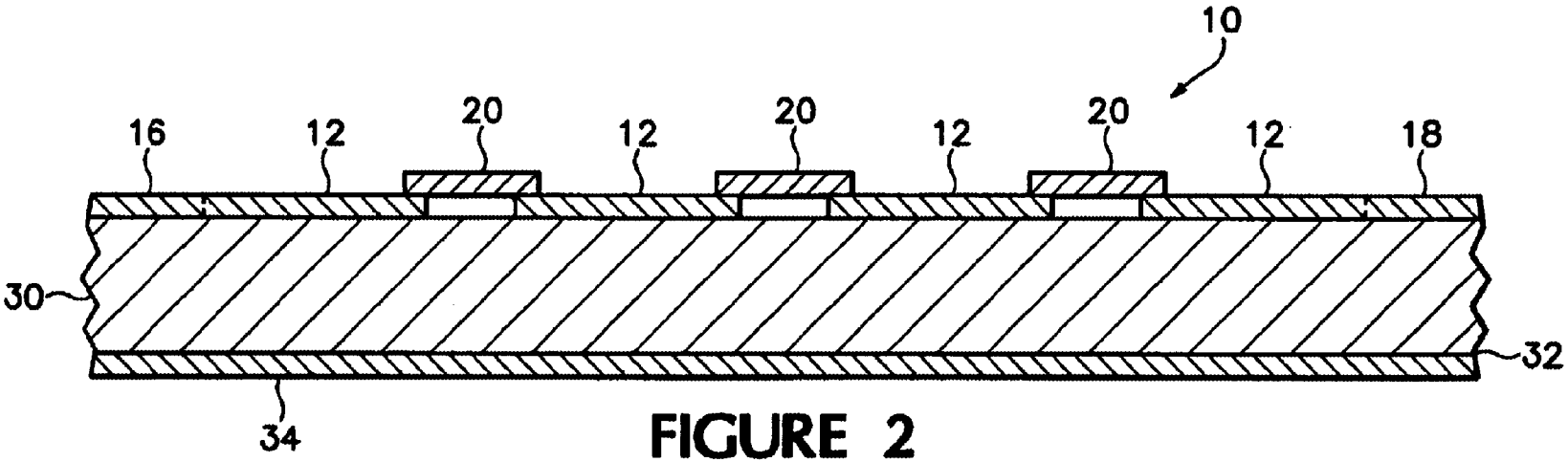
FIG. 2 is a side sectional view along section line A–A' of FIG. 1A of the adjustable delay line phase shifter according to the present invention.

FIG. 2 is a side sectional view along line A–A' of FIG. 1A of the adjustable delay line 10. The conductive elements 12 of the delay line 10 and the input and output transmission lines 16 and 18 are formed on a alumina substrate 30 having an optimal thickness of 25 mils for producing a characteristic impedance of 50 ohms. The bottom surface 32 of the substrate 30 has a gold metallized ground plane layer 34 having an optimal thickness of 0.2 mils. The conductive elements 12 and the transmission lines 16 and 18 are formed of gold and have an optimal thickness of 0.2 mils. The conductive members 20 are 0.2 mils thick gold ribbon conductors.

Figure 3:
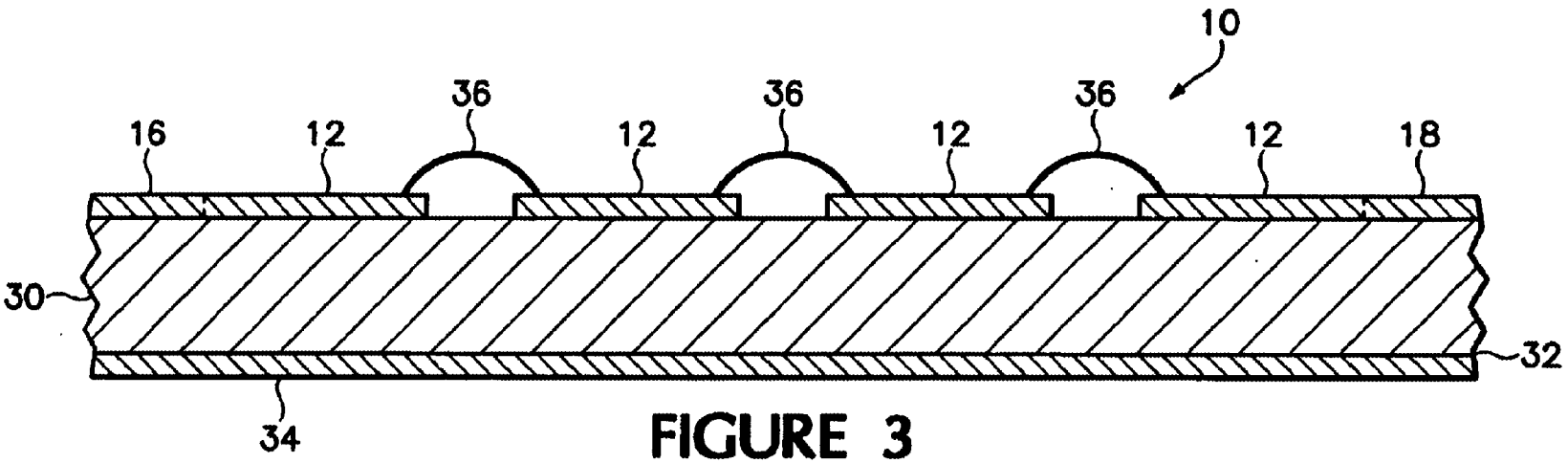
FIG. 3 is a side sectional view along section line A–A' of FIG. 1A illustrating alternative connective members in the adjustable delay line phase shifter according to the present invention.

FIG. 3 illustrates alternative conductive members 36 in the form of wire bonds. The bond wire conductive members 36 have a diameter in the range of 1.0 mil. Preferably, a minimum of two to three bond wires 36 are used to connect each of the respective conductive elements 12 together. An additional two to three bond wires 36 may be used for each connection to get the impedance of the connections closer to the characteristic impedance of the transmission lines or to reduce stray inductance.

Figure 4:
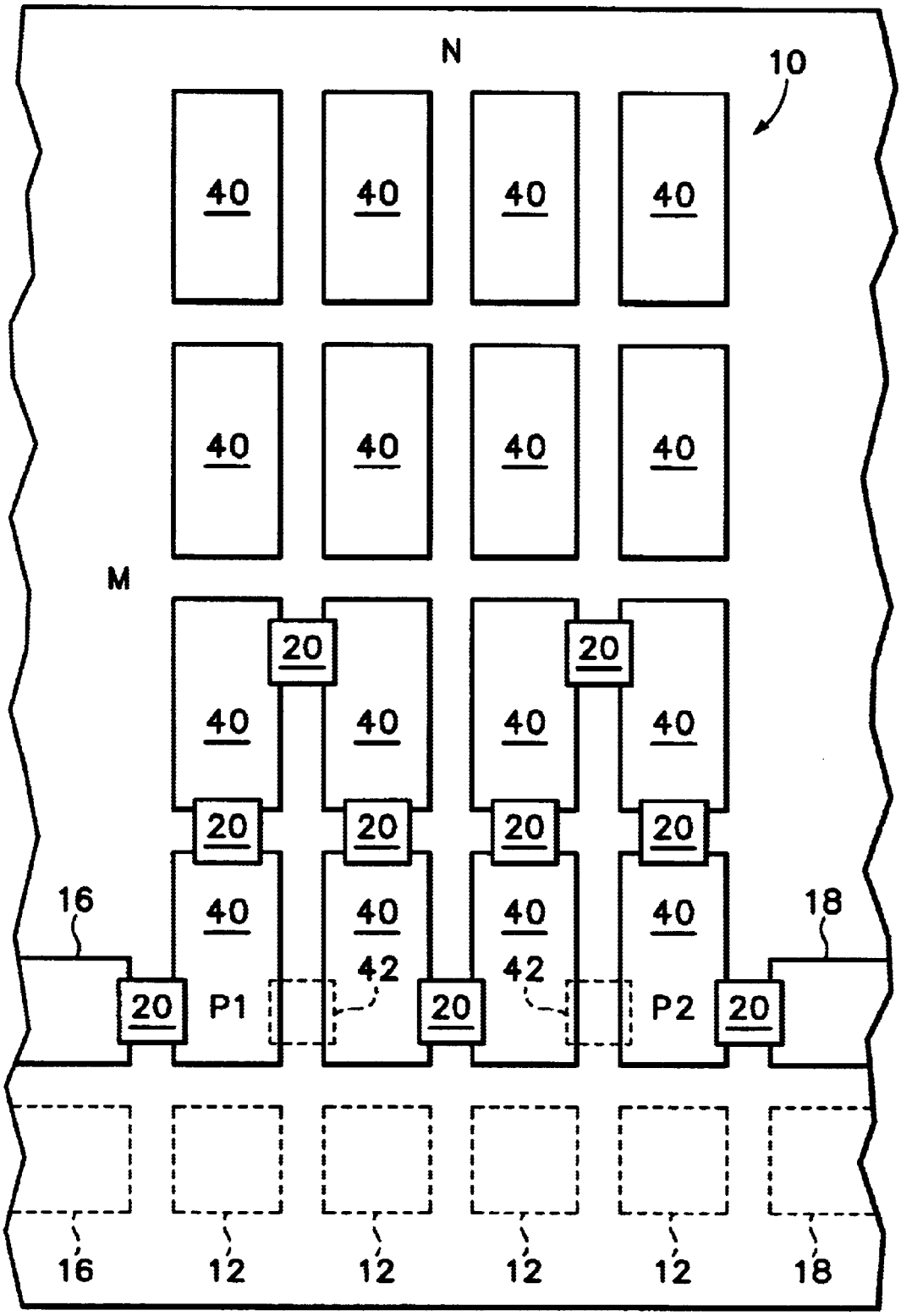
FIG. 4 is an alternative embodiment of the adjustable delay line phase shifter according to the present invention.

FIG. 4 is an alternative embodiment of the adjustable delay line 10 using M×N rectangular conductive elements 40. The embodiment also shows the input and output ports P1 and P2 being formed by connecting the bottom portions of the lowest rectangular conductive elements 40 of the outside columns to incoming and outgoing transmission lines 16 and 18 with conductive members 20, such as a 20 mil wide gold ribbon or multiple wires bonds. The rectangular shape of the conductive elements 40 necessitates serpentine connection patterns for the various configurations of the delay line 10. A straight connection pattern, as represented by the transmission lines 16 and 18 being connected across the bottom row of the matrix using conductive members 20 and 42, results in stubs being formed by each rectangular conductive element 40 causing reflections. The embodiment of FIG. 4 also illustrates the combination of square conductive elements 12 with the rectangular conductive elements 40 in the formation of conductive element matrix of the adjustable delay line 10. It should be noted that placement of the square and rectangular conductive elements in the matrix is not limited to a particular row or column and that square and rectangular conductive elements may be placed anywhere in the matrix.

Figure 5:
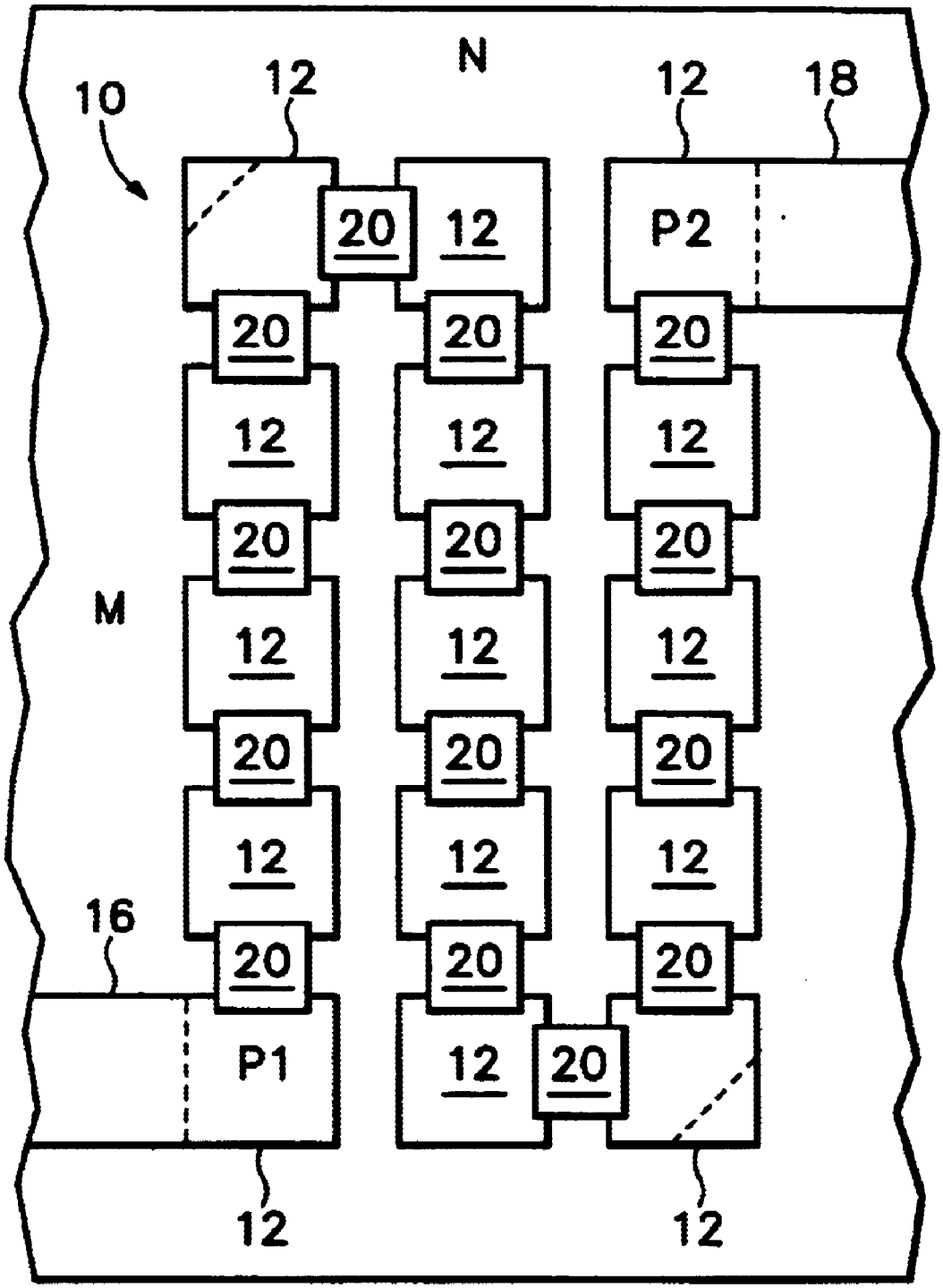
FIG. 5 is another alternative of the adjustable delay line phase shifter according to the present invention.

Referring to FIG. 5, there is a further embodiment of the adjustable delay line phase shifter 10 of the present invention. The delay line 10 has a matrix of M×N conductive elements 12 configured in three columns by five rows. The input and output transmission lines 16 and 18 are connected at opposite corners of the delay line matrix as compared to the previous embodiments where the transmission lines 16 and 18 are connected to the adjacent corners. The conductive elements 12 are connected together with the previously described conductive members 20. The figure also shows that some of the conductive elements 12 may be trimmed or formed with beveled corners, such as the opposing corners away from the input and output ports P1 and P2, to increase the bandwidth of the adjustable delay line 10. Once the correct configuration for the delay line is determined, the corners of the conductive members 12 associated with the turns in the delay line may be laser trimmed or the thick film layout of the delay line may be changed to incorporate the beveled corners. In narrow bandwidth application, square or rectangular conductive elements 12 could have an appreciable affect on the response of the adjustable delay line 10.

Figure 6:
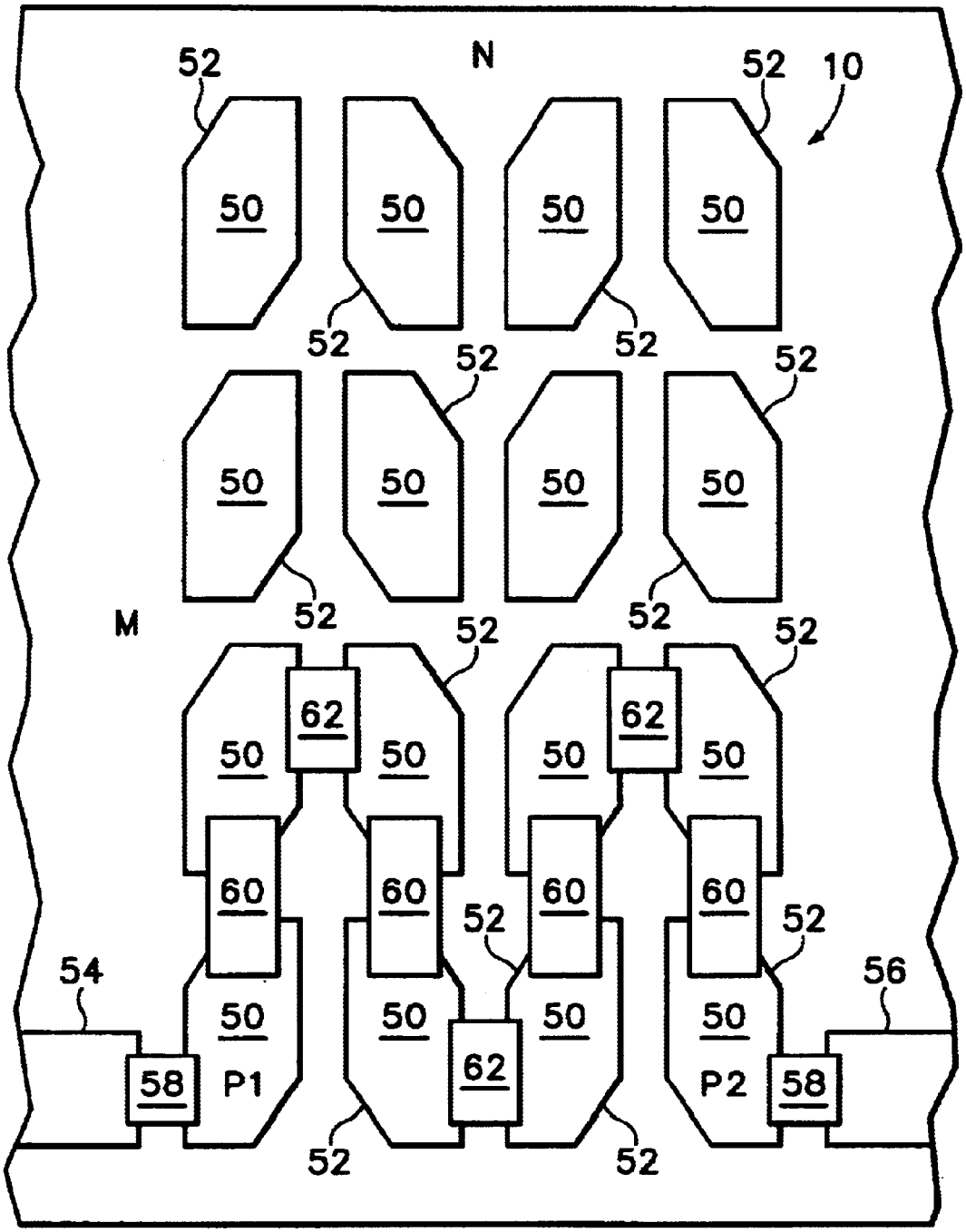
FIG. 6 is a further alternative embodiment of the adjustable delay line phase shifter according to the present invention.

FIG. 6 illustrates a further alternative embodiment of the adjustable delay line phase shifter 10 similar to that shown in FIG. 4. The conductive elements 50 are rectangular in shape having opposing beveled corners 52. The beveled corners 52 in the adjacent conductive element columns are reversed which produces mirrored conductive elements 50 in each respective column. Input and output ports P1 and P2 are formed by connecting the bottom portions of the beveled rectangular conductive elements 50 of the outside columns to respective incoming and outgoing transmission lines 54 and 56 with conductive members 58. Conductive members 60 and 62 connect the beveled rectangular conductive members 50 together in a representative serpentine pattern. The conductive members 60 connecting the beveled conductive elements 50 in the respective columns are longer than the conductive members 62 connecting the beveled conductive elements-50 in the respective rows. The longer conductive members 60 overlap the corner bevels 52 of the conductive elements 50. Such a configuration for the conductive elements 50 provides a more uniform characteristic impedance for the adjustable delay line phase shifter 10.

Figure 7:
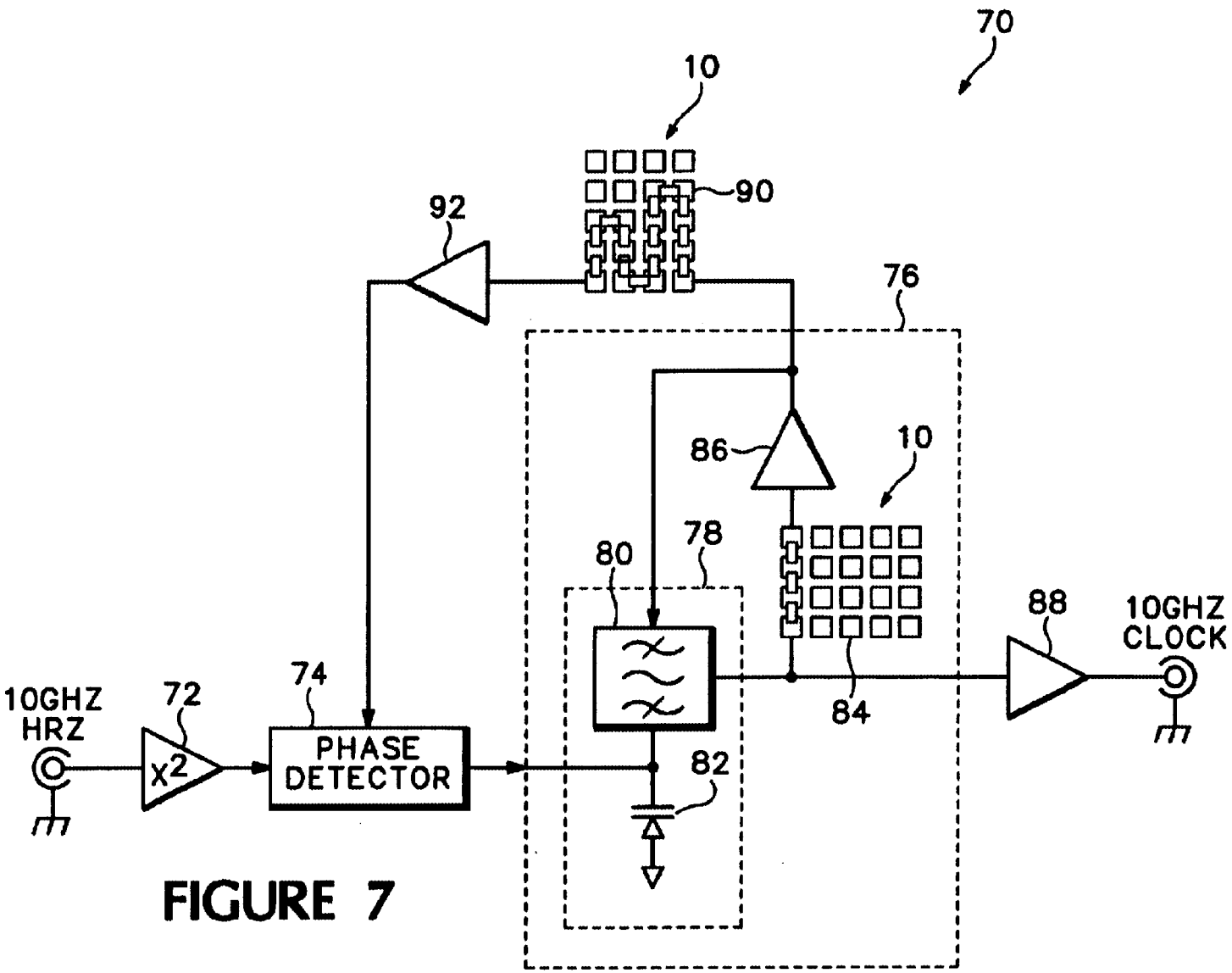
FIG. 7 is a schematic representation of a simplified clock recovery circuit incorporating the adjustable delay line phase shifter according to the present invention.

Referring to FIG. 7, there is shown a schematic representation of a simplified clock recovery circuit 70 using the adjustable delay line phase shifter 10 of the present invention. The adjustable delay line phase shifter is well suited for use in clock recovery circuits. In such a circuit, the resonant frequency of a resonator is initially tuned to a nominal frequency by adjusting the phase of the resonator output frequency using a first adjustable delay line phase shifter and then adjusting the phase of resonator output signal edges to the input signal edges using a second adjustable delay line phase shifter. In the preferred embodiment of the invention, the clock recovery circuit 70 is formed on a hybrid substrate using a thick film screening process to form runs and the adjustable delay line phase shifters 10. The clock recovery circuit 70 receives a 10 Gb/s NRZ (Non-Return to Zero) data input signal that is squared by a squaring circuit ($X^2$) 72. The squared signal is coupled into a phase detector 74. A voltage controlled oscillator (VCO) 76 is formed by a resonator 78, as represented by a bandpass filter 80 and a diode 82, an adjustable delay line phase shifter 84, and an amplifier 86. The resonator nominal frequency is set to 10 GHz. The amount of phase shift required from the adjustable delay line phase shifter 84 is an amount needed for a 360 degree multiple of the loop phase of oscillator 76 at 10 GHz.

The voltage controlled oscillator signal has an output path through amplifier 88 for outputting the 10 GHz clock signal, and a phase-locked loop (PLL) feedback path through adjustable phase shifter 90 and amplifier 92. Amplifier 92 couples the VCO signal to the phase detector 74. The phase detector 74 compares the timing of the edges of the NRZ data signal with the voltage controlled oscillator signal. Since the phase detector 74 is not a frequency detector, the phase of the 10 GHz oscillator signal presented at its input needs to be set so that there is no static phase error when compared to the 10 Gb/s NRZ signal. One way to do this is by setting the correct amount of phase shift through the second adjustable phase shifter 90.

Initially, the adjustable delay line phase shifters 84 and 90 are configured with a minimum amount of delay. The resonator 78 frequency is set so the peak of the amplitude response is at 10 GHz. The oscillator is then turned on, and the phase shifter 84 is adjusted to make the oscillator frequency correct. Setting the amount of phase on the adjustable phase shifter 90 is done by monitoring the amount of static phase error voltage on the phase detector 74 output, and adjusting the phase in the shifter 90 to minimize the error voltage.

As has been shown by the various embodiments of the adjustable delay line phase shifter, many different configurations of the conductive elements is possible. An additional shape for the conductive elements is an octagon. Any form of geometric or non-geometric shape, such as a circle, amoeba shapes or the like, may be used so long as the overall characteristic impedance of the delay line in not compromised.

An adjustable delay line phase shifter has been described using a microstrip transmission line that is formed on a hybrid substrate. The adjustable delay line phase shifter is implemented using a thick film screening process but may also be implemented using thin film deposition processes. The adjustable delay line phase shifter is formed on the top surface of a dielectric substrate, such as alumina, that has a conductive ground layer on its bottom surface. The adjustable delay line has a matrix of conductive elements that are connected together in various configurations using conductive members, such as gold ribbon or wire bonds.

It will be obvious to those having skill in the art that many changes may be made to the details of the above-described embodiments of this invention without departing from the underlying principles thereof The scope of the present invention should, therefore, be determined only by the following claims.

What is claimed is:

1. A delay line comprising:

a dielectric substrate having an upper surface and a lower surface;

a conductive ground layer deposited on the lower surface; and a matrix of filled conductive elements deposited on the upper surface in M rows and N columns where M and N are each equal to or greater than 2 such that N−1 to (M×N)−1 conductive members electrically connect from N to (M×N) conductive elements together with at least a first one of the conductive elements acting as an input port and a second one of the conductive elements acting as an output port to form an electrical path between the input and output ports, a desired delay time for the delay line being determined by the number of conductive elements in the matrix that are electrically connected between the input port and the output port and the desired delay time being in a range from a minimum to a maximum achievable delay time for the delay line.

2. The delay line as recited in claim 1 wherein the conductive elements are substantially square.

3. The delay line as recited in claim 1 wherein the conductive elements are substantially rectangular.

4. The delay line as recited in claim 3 wherein the substantially rectangular conductive elements further comprise beveled corners on the diagonally opposing corners of the substantially rectangular conductive elements.

5. The delay line as recited in claim 1 wherein the conductive members further comprise gold ribbons.

6. The delay line as recited in claim 1 wherein the conductive members further comprise at least one bonding wire.

7. The delay line as recited in claim 1 wherein the conductive members further comprise a plurality of bonding wires.

8. The delay line as recited in claim 1 further comprising:

an input transmission line coupled by an input conductive member to the input port; and an output transmission line coupled by an output conductive member to the output port.

9. A method of making a delay line of various electrical lengths from a common configuration while using a minimum area of a dielectric substrate comprising the steps of:

depositing a conductive ground layer on a lower surface of the dielectric substrate;

depositing a matrix of filled conductive elements on an upper surface of the dielectric substrate in M rows and N columns where M and N are each equal to or greater than 2; and electrically connecting N to (M×N) conductive elements together with N−1 to (M×N)−1 conductive members according to a desired delay time for the delay line with at least a first one of the conductive elements acting as an input port and a second one of the conductive elements acting as an output port such that the conductive members complete an electrical path between the input and output ports, the desired delay time being in a range from a minimum to a maximum achievable delay time for the delay line and being determined by the number of conductive members electrically connected between the input port and the output.

10. The method as recited in claim 9 wherein the conductive elements are substantially square.

11. The method as recited in claim 9 wherein the conductive elements are substantially rectangular.

12. The method as recited in claim 11 wherein the substantially rectangular conductive elements have respective beveled corners on diagonally opposing corners.

13. The method as recited in claim 9 wherein the conductive members are gold ribbons.

14. The method as recited in claim 9 wherein the conductive members are a plurality of bond wires.

15. The method as recited in claim 9 further comprising the step of depositing an input transmission line contiguous with the first one of the conductive elements and an output transmission line contiguous with the second one of the conductive elements on the dielectric substrate.

16. The method as recited in claim 9 further comprising the step of depositing an input transmission line for coupling by an input conductive member to the input port and an output transmission line for coupling by an output conductive member to the output port on the dielectric substrate.

* * * * *